US008287302B2

(12) United States Patent
Aguren

(10) Patent No.: US 8,287,302 B2
(45) Date of Patent: Oct. 16, 2012

(54) CABLE END CONNECTORS

(75) Inventor: Jerry G. Aguren, Tomball, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 17 days.

(21) Appl. No.: 12/902,443

(22) Filed: Oct. 12, 2010

(65) Prior Publication Data

US 2011/0086539 A1 Apr. 14, 2011

Related U.S. Application Data

(60) Provisional application No. 61/250,901, filed on Oct. 13, 2009.

(51) Int. Cl.
*H01R 3/00* (2006.01)

(52) U.S. Cl. ..... 439/490

(58) Field of Classification Search ..... 439/490, 439/910, 577, 488
See application file for complete search history.

(56) References Cited

U.S. PATENT DOCUMENTS

| | | | | |
|---|---|---|---|---|
| 5,207,594 | A * | 5/1993 | Olson | 439/490 |
| 5,277,620 | A * | 1/1994 | Taylor | 439/490 |
| 5,320,560 | A * | 6/1994 | Fladung | 439/490 |
| 5,567,175 | A * | 10/1996 | Warden et al. | 439/490 |
| 5,924,889 | A | 7/1999 | Wang | |
| 6,095,851 | A * | 8/2000 | Laity et al. | 439/490 |
| 2006/0003621 | A1 | 1/2006 | Kolvick | |

* cited by examiner

*Primary Examiner* — Javaid Nasri

(57) ABSTRACT

A cable end connector has a main body portion and male connector portions extending therefrom. The male connector portions are respectively receivable in recesses in an end portion of a cable connection component. The cable end connector is adapted to display status light signals emitted from between the recesses at the end portion of the cable connection component.

20 Claims, 6 Drawing Sheets

CABLE END CONNECTORS

CROSS-REFERENCE TO RELATED APPLICATIONS

This application claims the benefit of provisional application No. 61,250,901 filed 13 Oct. 2009.

BACKGROUND

It is known to provide status indicator lights relating to cable connections for electronic equipment, for example to indicate the link status of a computer network device port. Such lights can be provided for example on a front panel of the equipment or on a rear panel of the equipment in a vicinity of a relevant port. Some cable connection components are receivable within a housing of a host device for enabling communication between an external cable and a circuit of the host device. If it is desired for such a cable connection component to provide visible indications outside of the host housing, difficulties can arise.

BRIEF DESCRIPTION OF THE DRAWINGS

In order that the invention may be well understood, various embodiments thereof will now be described, by way of example only, with reference to the accompanying drawings, in which.

DETAILED DESCRIPTION

Figure 5:
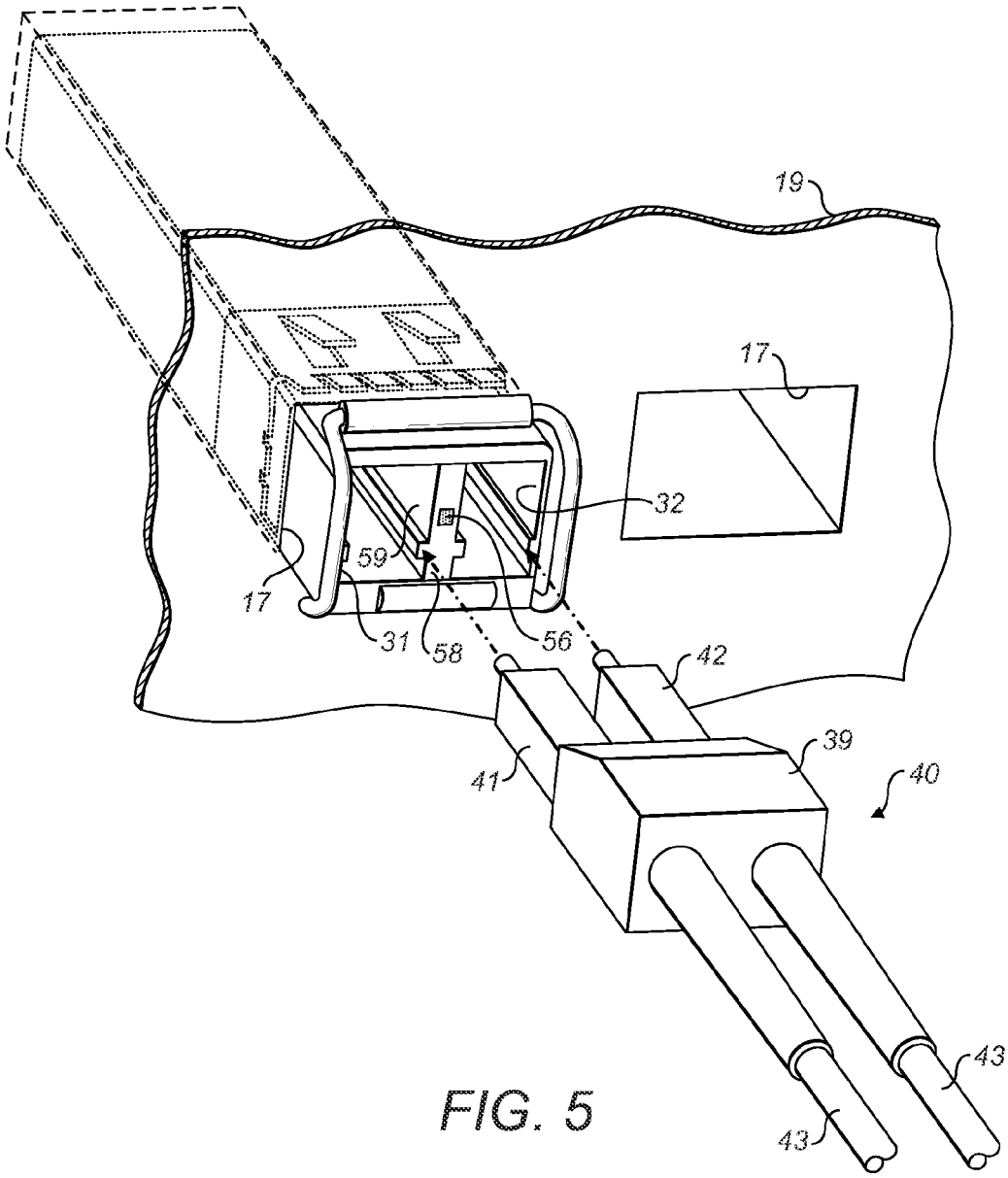
FIG. 5 shows the cable connection component received within the host housing.

Referring to FIGS. 1 to 5, a connection device in the form of a cable connection component 10 comprises a body 20 having rear portion 25 and a front end portion 30. The rear portion 25 is removably receivable within a housing 19 (partially shown in FIGS. 4 and 5) of a host information handling device, for example a switch or other network device. The cable connection component 10 includes a printed circuit board (PCB) 21 providing a control circuit for controlling the cable connection component 10. A rear end portion of the printed circuit board 21 carries electrical contacts 22 for connection to contacts 23 coupled to a circuit 18 of the host device. The rear portion 25 of the cable connection component 10 is removably pluggable, to couple to the cable connection component PCB 21 with the host device circuit 18, through an access opening 17 of the host housing 19 that enables access between the connection component 10 and external cabling. Conveniently, a cage 16 is provided within the host housing 19 in alignment with the access opening 17 and the contacts 23 of the circuit 18, for guiding and/or securing the rear body portion 25 relative to the host housing 19. With the rear portion 25 of the cable connection component body 20 received in the host housing 19, the front end portion 30 is located at or immediately adjacent the access opening 17 of the host housing 19, as shown in FIG. 5.

At the front end portion 30 thereof, the cable connection component body 20 defines two openings 31, 32 to respective recesses for receiving respective male connector portions 41, 42 extending from a main body portion 39 of a cable end connector 40 (FIG. 5) for external cabling 43, for example single mode or multi mode optical fibre cabling. The body 20 includes a divider in the form of a central dividing wall 59 that vertically divides the openings 31, 32 and recesses, the wall 59 having a front edge 58. The body 20 also accommodates a transmitter optical subassembly (TOSA) 51 and a receiver optical subassembly (ROSA) 52 which are electrically coupled for communication with the PCB 21. In use, with the cable end connector 40 inserted in the body 20, the male connector portions 41, 42 are respectively optically coupled to the TOSA 51 and ROSA 52. The TOSA 51 comprises, for example, an LED or laser source and signal conditioning electronics, and injects a signal into a fibre cable. The ROSA 52 includes, for example, a photodiode semiconductor, signal conditioning circuitry and an amplifier, and converts light received from an optical cable into electrical signals. At the front end portion 30, the cable end connector 10 can also include a securing mechanism activated by a hinged lever, or bail, 33 for securing a cable end connector 40 relative to the cable connection component 10.

Various aspects of the cable connection component 10 and other items described herein may be provided in accordance with one or more agreed standards. For example, the cable connection component 10 of the present embodiment can comprise an SFP-type optical transceiver having a mechanical interface according to the INF-8074i specification for (SFP) Small Formfactor Pluggable Transceiver published by the SFF Committee industry group. The term SFP-type as used herein relates to components that accord with any specification published by the SFF Committee that develops the SFP mechanical or electrical interface including, without limitation, specifications relating to SFP+ and QuadSFP. The invention is not limited to use with SFP-type optical transceivers. For example, the invention can be applied to other types of optical transceiver, SFPs for connecting to copper cables, SFF-type (non-pluggable) connection components (also specified by SFF Committee specifications), removably pluggable SFP-type cable end connectors such as active optical or active copper cable connectors, and to any other suitable cable connection component. The cable end connector 40 can be an LC connector, for example, as shown in FIG. 5, or any other type of connector suitable for connection to the cable connection component.

Figure 1:
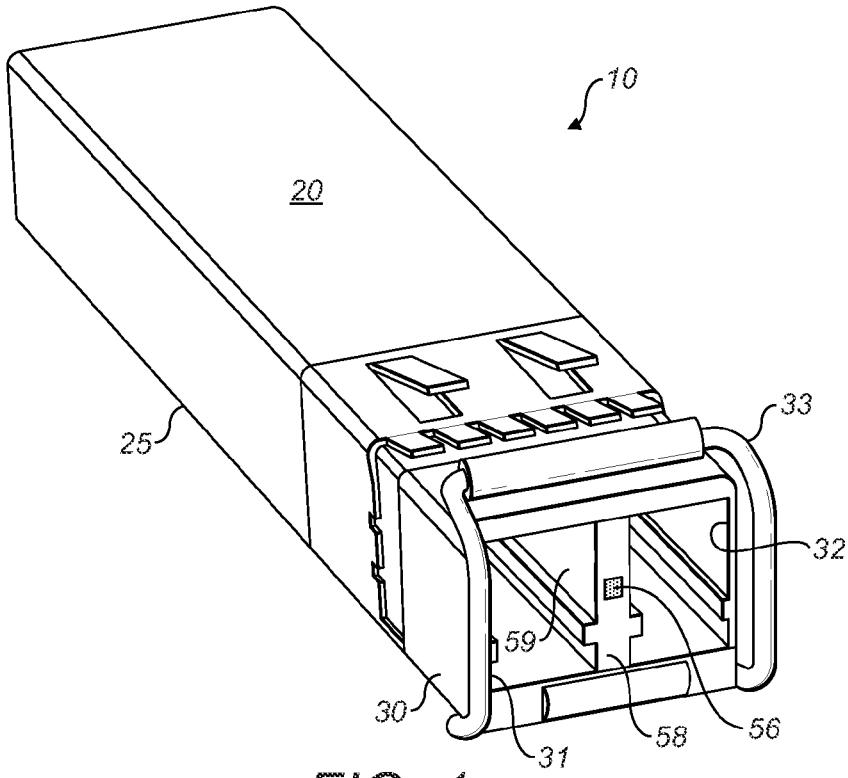
FIG. 1 is a perspective view of a cable connection component from the front, top and one side.
Figure 2:
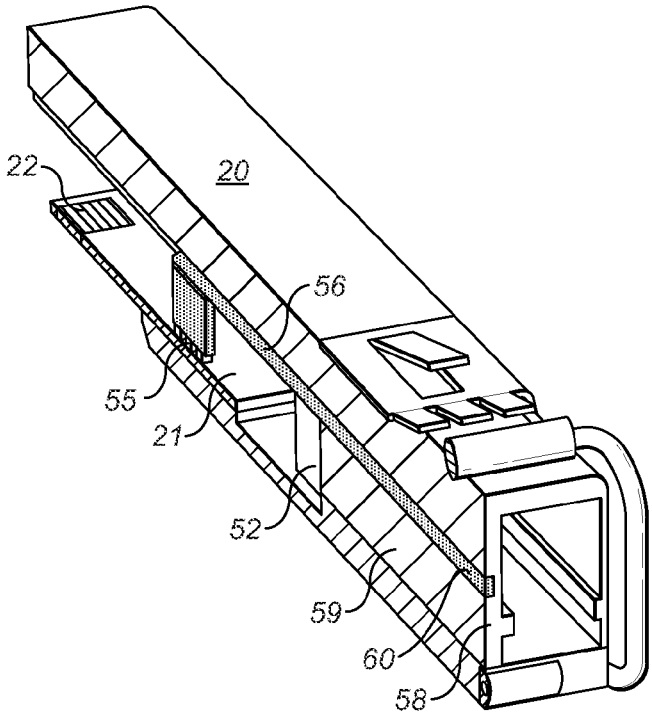
FIG. 2 is a perspective sectional view of portions of the component of FIG. 1.
Figure 3:
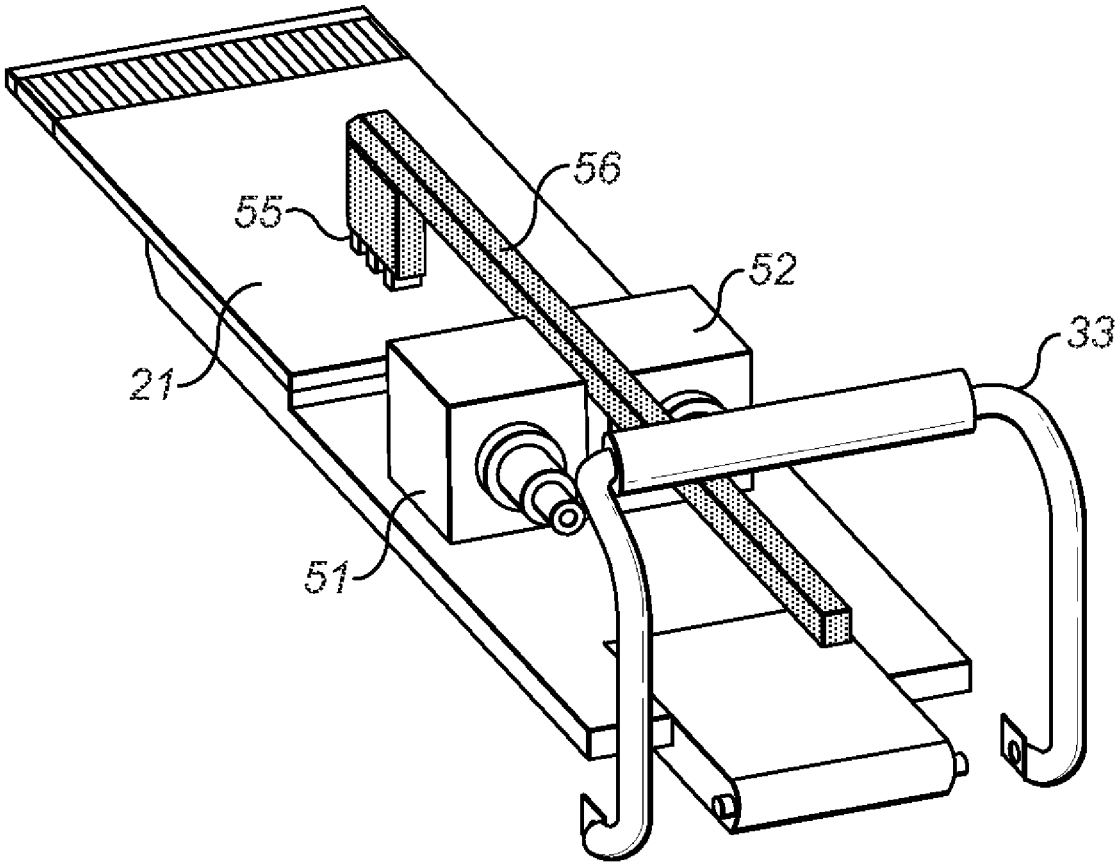
FIG. 3 is a perspective view of portions of the component of FIGS. 1 and 2, some portions having been removed for clarity.
Figure 4:
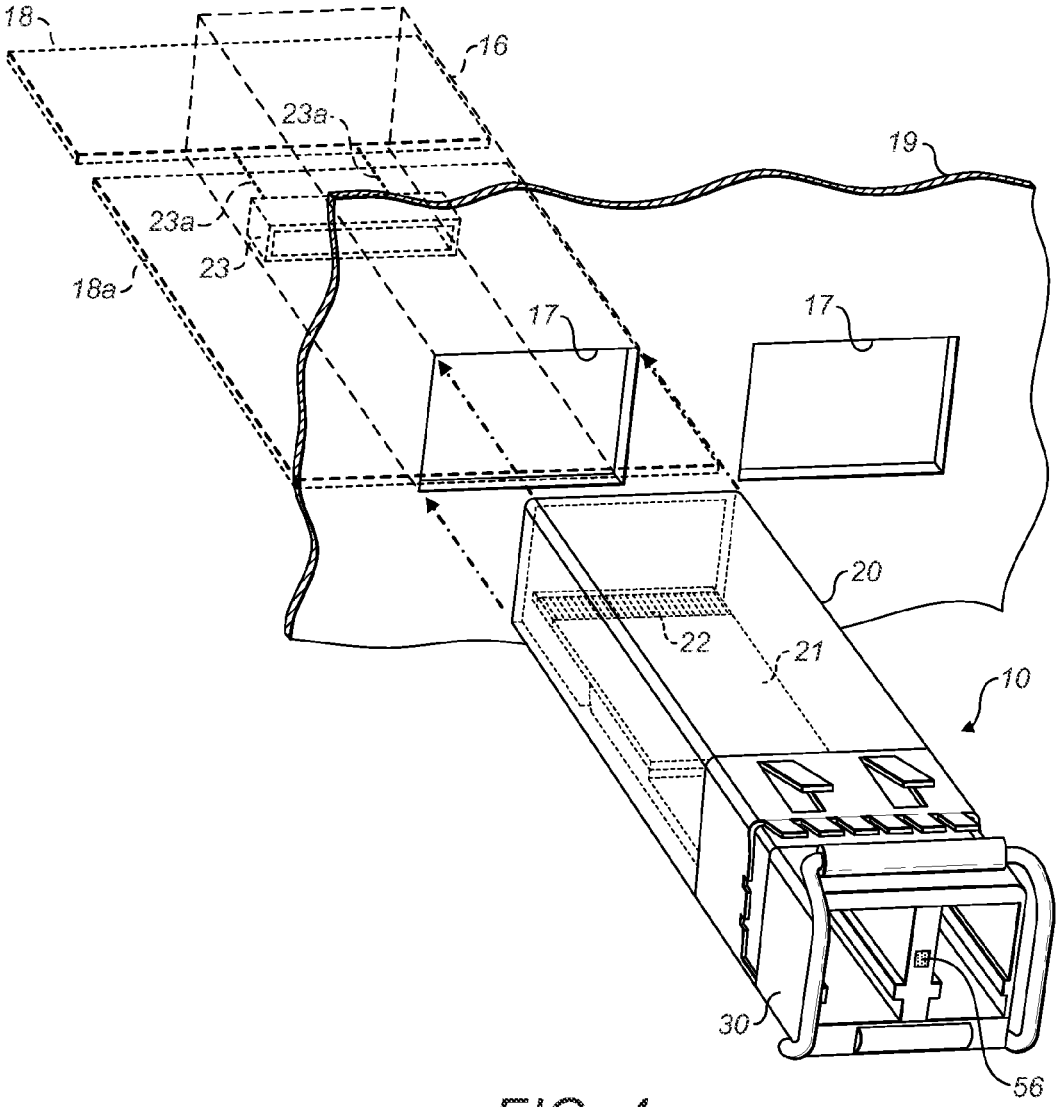
FIG. 4 illustrates how the cable connection component removably plugs through an opening in a housing of a host device into a cage within the host housing.

The inventor has developed a use for a visual indicator to provide signals at the front end of a cable connection component such as the SFP transceiver shown in FIGS. 1 to 5. Many modern cable connection components have very compact internal and external configurations. There is very little available space or opportunity at the front end portion 30 of an SFP-type connection component in which to mount a suitable light emitting device such as a light emitting diode (LED). As best seen in FIGS. 1 to 3, the PCB 21 is disposed to the rear of the TOSA 51 and ROSA 52 which in turn are rearwardly disposed of the front end portion 30. This creates a further difficulty in connecting a suitably positioned light emitting device to the PCB 21 for providing power and control to the light emitting device.

As best shown in FIGS. 2 and 3, the cable connection component 10 comprises a light emitting device in the form of at least one light emitting diode (LED) 55 connected to the PCB 21 at a location to the rear of the TOSA 51 and ROSA 52. The LED 55 can, for example, be directly connected to the PCB 21, which facilitates ease of manufacture and reliability of connection. The LED can be controlled by the PCB 21 to act as a status light for providing status signals. The LED 55 can be a multicolour device, for providing a wider range of possible signals. The cable connection component 10 further includes a light guide 56, for example a moulded plastic light tube, rectangular waveguide, or any other suitable configuration and/or material. For example, the light guide could alternatively comprise an optical fibre, for example having a core comprising poly methyl methacrylate (PMMA) and cladding comprising silicone resin, if desired supported by a plastic moulded support. The light guide 56 is configured to collect light from the LED 55 and guide the collected light to the front end portion 30 of the connection component 10. The central dividing wall 59 of the housing 20 is provided with a passage 60 to accommodate the light guide 56. The TOSA 51 and ROSA 52 in the embodiment of FIGS. 1 to 3 have reduced vertical dimensions in the region of the longitudinal axis of the connection component 10. The path of the light guide 56 passes centrally of the connection component 10 from the region of the PCB 21, laterally between and above portions of the TOSA 51 and ROSA 52 and through the passage 60 to emerge at the front edge 58 of the central wall 59.

The PCB 21 can control the LED 55 to provide visible indications at the front end portion 30 of the connection component 10. In use, with the connection component 10 received in the host housing 19, the light guide 56 is configured to guide light from the status light 55 within the housing 19 to the front end portion 30 of the connection component 10 to or through the access opening 17 of the host housing 19 to provide externally visible indications adjacent the host housing 19.

Figure 6:
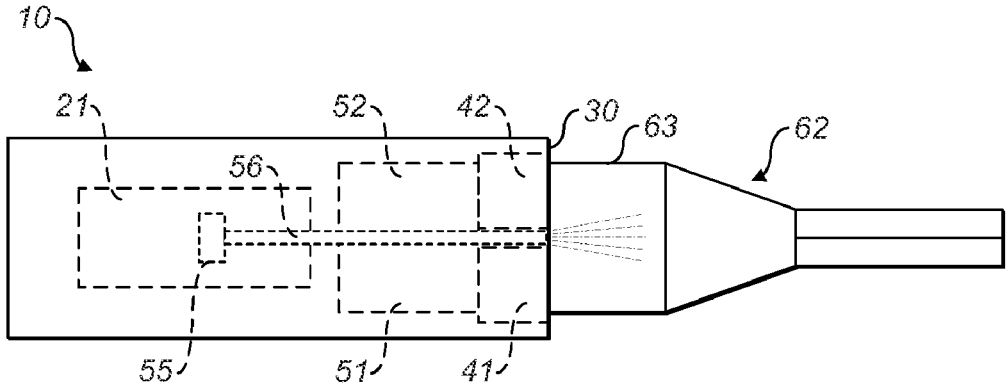
FIG. 6 is a schematic view of a cable end connector connected to the cable connection component.

Referring to FIG. 6, a cable end connector 62 is removably connected to a cable connection component 10 that provides visible indications at an end portion 30 thereof, for example such as the SFP-type transceiver 10 described above with reference to FIGS. 1 to 5. In alternative embodiments, the visible indications can be provided by other light emitters than a light guide, for example an LED connected to the PCB 21 and disposed between male connector receiving recesses at the end portion of the cable connection component, the recesses being aligned with the TOSA and ROSA, for example of an SFP-type transceiver. At least a portion of an outer body 63 of the connector 62 is made of a transparent or translucent material, and the connector 62 is configured such that, when connected to the cable connection component 10, light from the visible indication is transmitted through the transparent or translucent material with sufficient intensity to be visible externally of a host device housing. Conveniently, the entire connector outer body 63, or a major portion thereof, is manufactured from one or more transparent or translucent materials. In the embodiment of FIG. 6, at least a major portion of the body 63 is transparent or translucent about the entire periphery of the body 63, to facilitate unobscured visibility of the visible indications in multiple different orientations of the connection component 10 and connector 62, and from multiple different viewing positions. Alternatively, for example, transparent or translucent windows can be provided in the connector outer body 63 at one or more peripheral locations about the periphery of the body 63. In this manner, the cable and connector 62 is adapted to display the visible indications provided by the cable connection component 10. The connector 62 can be, for example, an LC connector, or any other suitable type of connector for connecting to the cable connection component. In one embodiment, the main body portion 39 of the LC connector 40 shown in FIG. 5 is made of transparent or translucent material.

Figure 7:
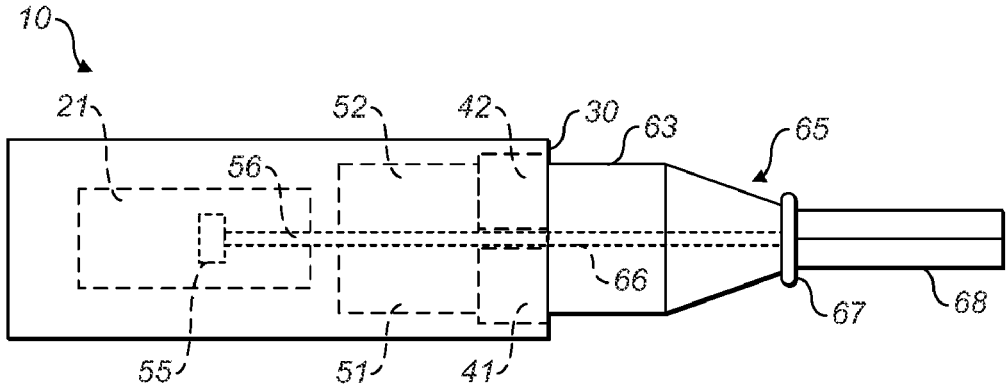
FIG. 7 is a schematic view of an alternative cable end connector connected to the cable connection component.

FIG. 7 shows an alternative cable end connector 65 adapted to display visible indications provided by a cable connection component. The cable end connector 65 comprises a light guide 66 to collect light emitted from a front end portion 30 of the cable connection component 10 and guide the collected light to a display region. In FIG. 7, the display region is provided by a peripheral transparent or translucent light guide in the form of a light pipe 67 extending about the periphery of a distal end portion of the end connector 65, adjacent to a region of entry of the cabling 68 to the connector. Alternatively, the peripheral light guide 67 could extend about the periphery of the cabling 68. In this manner, light signals from the cable end connector 65 are guided through the end connector 65 and made visible about the periphery of the end connector 65 or cabling 68. This facilitates visibility of the light signals in different orientations of the end connector 65 and from multiple different viewing positions, unobscured by, for example, the cabling 68 or the body of the end connector 65. The peripheral light guide 67 can in some embodiments extend only partially about the periphery of the end connector 65 or cabling 68, and/or be transparent or translucent only along a part or parts of its peripheral extent. In alternative embodiments, light can be displayed, for example, through transparent or translucent portions of the end connector 65 in the region of the distal end of the end connector 65, that is, in the region of the opposite end of the end connector 65 from the cable connection component 10.

Figure 8:
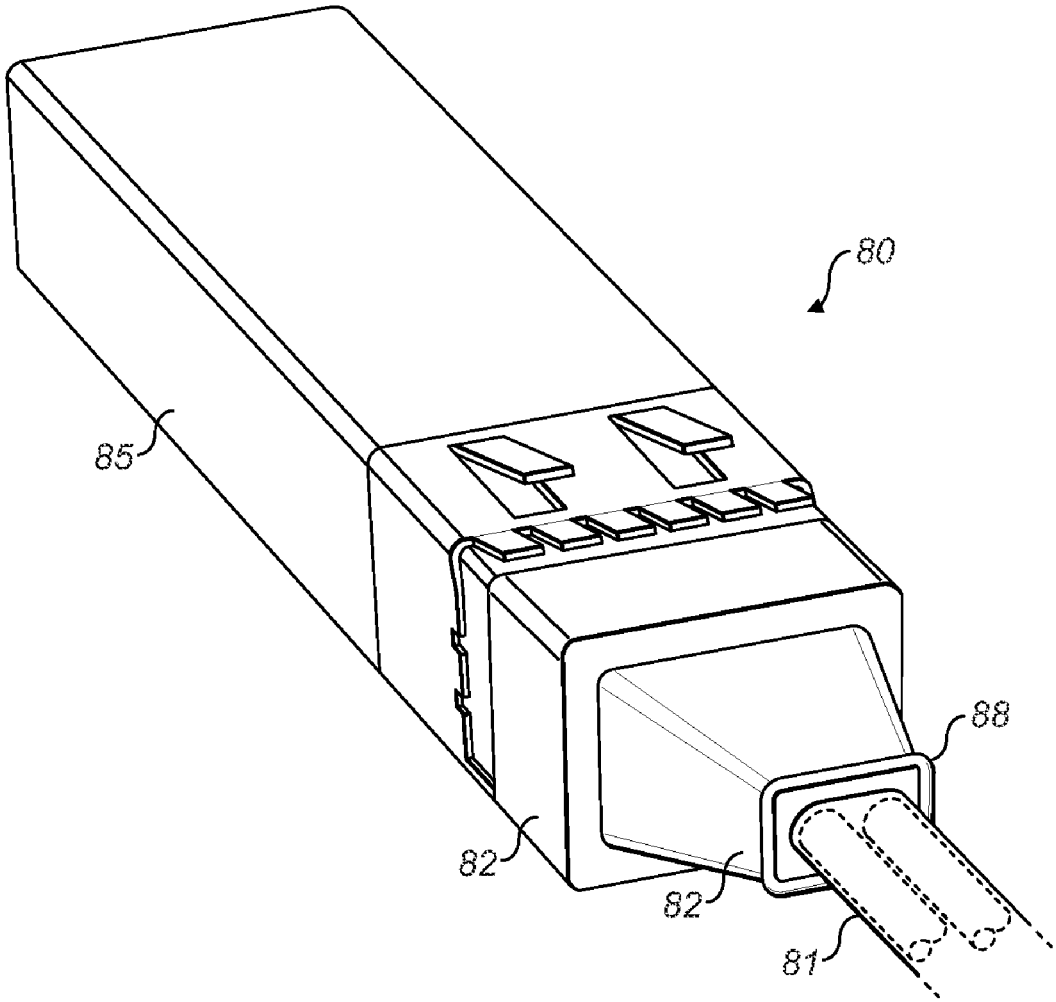
FIG. 8 shows a cable connection component integrally connected to cabling.

FIG. 8 shows an alternative cable connection component 80 comprising a rear portion 85, similar to rear portion 25 of FIG. 1, removably pluggable into a host device through an access opening 17. The connection component 80 is similar to the connection component 10 except that the connection component 80 is integrally connected to cabling 81 by an integral end portion 82 configured to extend, in use, externally of the host housing 19. Cables having this arrangement are sometimes referred to as active (for example active optical or active copper) cables. The integral end portion 82 is adapted to display visible indications externally of the host housing 19 using light from LED 55 that is guided along a light guide 86 to the integral portion 82. The visible indications can be displayed in any convenient manner. For example, light guide 86 can extend to a transparent or translucent body region similarly to the embodiment described with reference to FIG. 6. For example, the entire integral portion 82 outer body can be made from a transparent or translucent material. In alternative embodiments, the light guide 86 can extend to a distal region of the integral portion 82, and visible indications can be displayed using, for example, a peripherally extending light guide of the portion 82, such as an at least in parts transparent or translucent light pipe ring 88 as shown in FIG. 8, and/or or using transparent or translucent material elsewhere in the distal region, or in any other convenient manner.

While the present disclosure describes various embodiments, these embodiments are to be understood as illustrative and do not limit the claim scope. Many variations, modifications, additions and improvements of the described embodiments are possible. Variations and modifications of the embodiments disclosed herein may be made while remaining within the scope of the following claims.

What is claimed is:

1. A cable end connector, comprising:

a main body portion and male connector portions extending therefrom, the male connector portions being respectively receivable in recesses in an end- portion of a cable connection component, the cable end connector being adapted to display status light signals emitted from between the recesses at the end portion of the cable connection component, the male connector portions having optical connectors to optically couple with a TOSA and ROSA of the cable connection component when the male connector portions are inserted in the cable connection component.

2. The cable end connector of claim 1, comprising a light guide to collect the light from the signals emitted at the end portion of the cable connection component and guide the light to a display region.

3. The cable end connector of claim 2, wherein the display region comprises an at least in part transparent or translucent peripheral light guide extending peripherally of the connector and/or cabling.

4. The cable end connector of claim 3, wherein the peripheral light guide extends about a periphery of a distal end portion of the connector in a region of entry of cabling to the connector, and/or extends about the cabling.

5. The cable end connector of claim 3, configured for connection to an SFP-type connection component, wherein the peripheral light guide extends about a periphery of a distal end portion of the connector adjacent a region of entry of cabling to the connector, and/or extends about the cabling, to permit visibility of a signal light on the SFP-type connection component with the cable end connector connected with the SFP-type connection component.

6. The cable end connector of claim 1, configured for connection to an SFP-type connection component, wherein at least a portion of an outer body of the connector comprises a transparent or translucent material to permit visibility of a signal light on the SFP-type connection component with the cable end connector connected with the SFP-type connection component.

7. The cable end connector of claim 1, comprising an LC connector, wherein at least a portion of the main body of the connector comprises a transparent or translucent material.

8. The cable end connector of claim 1, wherein the male connector portions comprise respective optical connectors to receive optical signals from optical light sources disposed in recesses in the end portion of the cable connection component.

9. A cable end connector configured to passively visualise light from a light emitter disposed between recesses aligned with a TOSA and ROSA of an connection component when the connector is inserted in the connection component, the cable end connector having male connector portions With optical connectors to optically couple with the TOSA and ROSA of the connection component when the male connector portions are inserted in the recesses of the connection component.

10. The cable end connector of claim 9, having at least one transparent or translucent part to visualise the light.

11. The cable end connector of claim 9, comprising a light guide to collect the light from the signals emitted at the end portion of the cable connection component and guide the light to a display region.

12. The cable end connector of claim 11, wherein the display region comprises an at least in part transparent or translucent peripheral light guide extending peripherally of the connector and/or cabling.

13. The cable end connector of claim 12, wherein the peripheral light guide extends about a periphery of a distal end portion of the connector in a region of entry of cabling to the connector, and/or extends about the cabling.

14. The cable end connector of claim 9, further comprising male connector portions having respective optical portions to receive optical signals from optical light sources disposed in recesses in the end portion of the connection component.

15. A cable end connector, comprising:

a main body portion and male connector portions extending therefrom, the male connector portions being respectively receivable in recesses respectively aligned with a TOSA and ROSA in an end portion of a cable connection component, the cable end connector being adapted to permit viewing of light signals emitted from between the recesses at the end portion of the cable connection component, with the cable end connector inserted in the cable connection component, the male connector portions having optical connectors connected to fiber cables to optically couple with the TOSA and ROSA of the cable connection component when the male connector portions are inserted in the recesses of the cable connection component.

16. The cable end connector of claim 15, comprising a light guide to collect the light from the signals emitted at the end portion of the cable connection component and guide the light to a display region.

17. The cable end connector of claim 16, wherein the display region comprises an at least in part transparent or translucent peripheral light guide extending peripherally of the connector and/or cabling.

18. The cable end connector of claim 17, wherein the peripheral light guide extends about a periphery of a distal end portion of the connector in a region of entry of cabling to the connector, and/or extends about the cabling.

19. The cable end connector of claim 15, configured to permit viewing of the light signals from multiple directions around the periphery of the cable end connector, with the cable end connector inserted in the cable connection component.

20. The cable end connector of claim 15, wherein the male connector portions comprise respective optical connectors to receive optical signals from optical light sources disposed in recesses in the end portion of the cable connection component.

* * * * *

UNITED STATES PATENT AND TRADEMARK OFFICE

CERTIFICATE OF CORRECTION

PATENT NO. : 8,287,302 B2
APPLICATION NO. : 12/902443
DATED : October 16, 2012
INVENTOR(S) : Jerry G. Aguren It is certified that error appears in the above-identified patent and that said Letters Patent is hereby corrected as shown below:

In column 5, line 5, in Claim 1, delete "end-" and insert -- end --, therefor.

In column 5, line 53, in Claim 9, delete "With" and insert -- with --, therefor.

Signed and Sealed this
Nineteenth Day of February, 2013

Teresa Stanek Rea
*Acting Director of the United States Patent and Trademark Office*